US006805223B2

(12) United States Patent
Maury et al.

(10) Patent No.: US 6,805,223 B2
(45) Date of Patent: Oct. 19, 2004

(54) DEVICE FOR BLOCKING A SAFETY BRAKE FOR LIFT EQUIPMENT

(75) Inventors: Julien Maury, Luzern (CH); Stefan Hugel, Adligenswil (CH)

(73) Assignee: Inventio AG, Hergiswil (CH)

( * ) Notice: Subject to any disclaimer, the term of this patent is extended or adjusted under 35 U.S.C. 154(b) by 93 days.

(21) Appl. No.: 10/253,282

(22) Filed: Sep. 24, 2002

(65) Prior Publication Data

US 2003/0062224 A1 Apr. 3, 2003

(30) Foreign Application Priority Data

Sep. 28, 2001 (EP) ..... 01810946

(51) Int. Cl.[7] ..... B66B 5/18
(52) U.S. Cl. ..... 187/343; 187/357
(58) Field of Search ..... 187/343–347, 187/351, 357, 373

(56) References Cited

U.S. PATENT DOCUMENTS 249,076 A * 11/1881 Moulton ..... 187/343
700,458 A * 5/1902 Trapp ..... 187/346
1,581,458 A 2/1926 Lindquist
1,874,754 A * 8/1932 James ..... 187/343
1,923,683 A * 8/1933 Ohler ..... 187/373
1,932,060 A * 10/1933 Arnold ..... 187/357
5,713,434 A 2/1998 Sun
5,806,633 A * 9/1998 Macuga ..... 187/357

FOREIGN PATENT DOCUMENTS

JP 59-118678 7/1984

* cited by examiner

*Primary Examiner*—Eileen D. Lillis
*Assistant Examiner*—Thuy V. Tran
(74) *Attorney, Agent, or Firm*—Schweitzer Corman Gross & Bondell LLP

(57) ABSTRACT

An improvement for lift equipment having a lift cage and a counterweight movable in a lift shaft with travel buffers at at least one end permits override of safety brake operation when buffer travel occurs. The invention comprises a blocking device which blocks operation of the safety brake, and may include a blocking lever connected to a trip lever mechanism of the safety brake and a blocking element which controls the movement of the blocking lever.

4 Claims, 2 Drawing Sheets

DEVICE FOR BLOCKING A SAFETY BRAKE FOR LIFT EQUIPMENT

The present invention relates to lift equipment with a lift cage movable in a lift shaft and with a counterweight movable in the lift shaft, wherein the speed of the lift cage or the counterweight is monitored by means of a speed limiter device and the speed limiter device stops the lift cage or the counterweight by means of a safety brake in the case of excess speed of the lift cage or the counterweight.

BACKGROUND OF THE INVENTION

In the case of lift equipment with a lift cage and counterweight movable in a shaft the speed of the lift cage or the counterweight is monitored. When excess speed occurs the lift cage or the counterweight is stopped by means of a safety brake. If, for example, the lift cage travels beyond the bottom story in the downward direction with less than an excess speed the lift cage is, on further travel thereof, caught by buffers. In that case, the safety brake can be tripped due to the inertia of the speed limiter and the limiter cable, whereby the braking elements of the safety brake wedge with the guide rails.

A disadvantage of known equipment resides in the fact that the lift cage has to be released from the brake. The safety brake has to be reset and the guide rails checked at the braking location and the surface processed. Evacuation of the lift passengers can be undertaken only by expert personnel.

The present invention addresses the disadvantages of the known equipment. The invention includes a speed monitor which applies a safety brake when excess speed of the lift cage or counterweight occurs. A blocking device is associated with the safety brake to block brake action when buffer travel of the lift cage or counterweight occurs.

The advantages achieved by the invention are essentially to be seen in that the safety brake is not tripped in the case of buffer travel. The lift passengers are thus not needlessly exposed to extreme decelerations of the lift cage. Moreover, expert personnel are not needed for carrying out evacuation of the lift passengers.

The lift cage can, after buffer travel, be manually moved to the next story so that the lift passengers can leave the lift cage. Moreover, the mechanical components of the safety brake, and the speed limiter and the guide rails are treated gently. In the case of buffer tests, the safety brake is not tripped and the considerable effort needed for release of the brake is avoided. In the case of approval tests, the safety brake is usually blocked, so that no instances of braking can occur in the shaft end regions in the event of out-of-the-ordinary test travels. With the equipment according to the invention, safety is guaranteed over the entire shaft height even in the case of approval tests.

BRIEF DESCRIPTION OF THE DRAWINGS

The present invention is explained in more detail by reference to the accompanying figures, in which.

DETAILED DESCRIPTION OF THE INVENTION

Figure 1:
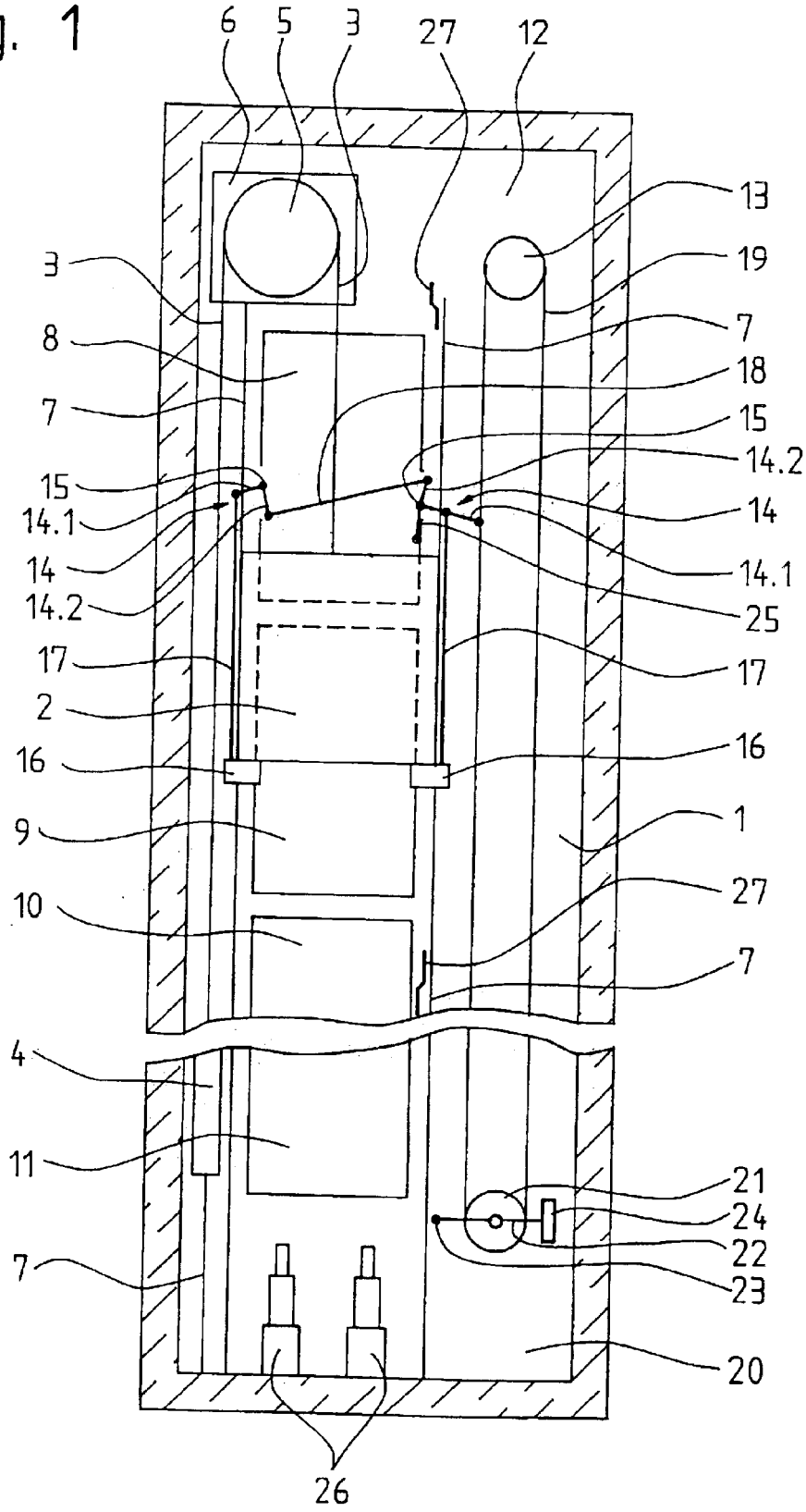
FIG. 1 is a diagrammatic view of lift equipment with a safety brake for stopping a lift cage incorporating the invention.

FIG. 1 shows lift equipment with a lift cage 2 movable in a lift shaft and connected with a counterweight 4 by way of a cable 3. The cable 3 is driven in the operational case by means of a drive pulley of a drive unit 6. Lift cage 2 and counterweight 4 are guided by means of guide rails 7 extending over the shaft height. The lift equipment comprises a top story with a top story door 8, a second-to-top story with a second-to-top story door 10, further stories with further story doors 10 and a bottom story with a bottom story door 11. The drive unit 6 and a speed limiter 13, which monitors the speed of the lift cage 2 and stops the lift cage 2 if excess speed occurs, are arranged in a shaft head 12. A respective double lever 14, which is pivotably mounted at a fulcrum 15 of the lift cage 2, is provided at each side of the lift cage 2. A safety brake 16 for stopping the lift cage 2 is connected by means of a linkage 17 with one side 14.1 of the double lever 14, which side 14.1 is also connected to limiter cable 19 of the speed limiter 13. The other side 14.2 of one double lever 14 is connected by means of a linkage 18 with the other double lever. If one side 14.1 of the double lever 14 is moved upwardly, then the safety brake 16 engaged, whereby braking elements wedging with the guide rails 7 stop the lift cage in the case of emergency. In the operational case, the lift cage 2 drives the limiter cable 19 by means of the one side 14.1 of the double lever 14. In the case of excess speed of the lift cage 2, the speed limiter 13 blocks the limiter cable 19. The one side 14.1 of the double lever 14 is thereby deflected upwardly and the safety brake engaged at both sides of the lift cage 2.

The endless limiter cable 19 is tensioned by means of a deflecting roller 21 arranged in a shaft pit 20, wherein a roller support 22 is pivotably mounted at one end at a fulcrum 23 and carries a tensioning weight 24 at the other end.

A blocking lever 25 is connected at the fulcrum 15 with one double lever 14. In the event of tripping as mentioned above, side 14.1 of one double lever 14 is deflected upwardly. At the same time, the blocking lever 25 is deflected in the anticlockwise sense.

FIG. 1 shows the lift cage 2, which has set off at the top story, on the way down, wherein a stop at the second-from-bottom story and subsequently at the bottom story is provided. If, for example, the travel from the second-to-bottom story to the bottom story runs at less than excess speed and the lift cage 2 does not halt at the bottom story, the lift cage 2 on its further travel downwardly is caught by buffers 26. In that case, the safety brake 16 can, due to the inertia of the speed limiter 13 and the limiter cable 19, be tripped, whereby the braking elements of the safety brake 16 wedge with the guide rails 7. In order to avoid undesired tripping of the safety brake 16 in the case of buffer travel of the lift cage 2 or the counterweight 4, there is provided in the lift shaft 1 at the top and bottom a blocking element 27 which blocks the movement of the blocking lever 25 as soon as the lift cage 2 or the counterweight 4 has travelled downwardly past the bottom story. When the counterweight 4 impinges on the buffer (not illustrated), the lift cage 2 hangs in the cable 3. The lower blocking element 27 prevents tripping of the safety brake 16 at the lower shaft end. The blocked blocking lever 25 blocks one double lever 14 and, by way of the linkage 18, the other double lever 14. Tripping of the safety brake 16 is thus precluded.

If the counterweight is monitored by means of a safety brake, a blocking lever and a blocking element with the above-illustrated effect are similarly provided.

At least one blocking element 27 is also provided at the upper shaft end if the upper shaft end also has buffers.

FIG. 1 shows lift equipment without a machine room. The equipment according to the invention for evacuation of lift passengers can also be used on lift equipment with a machine room.

Figure 2:
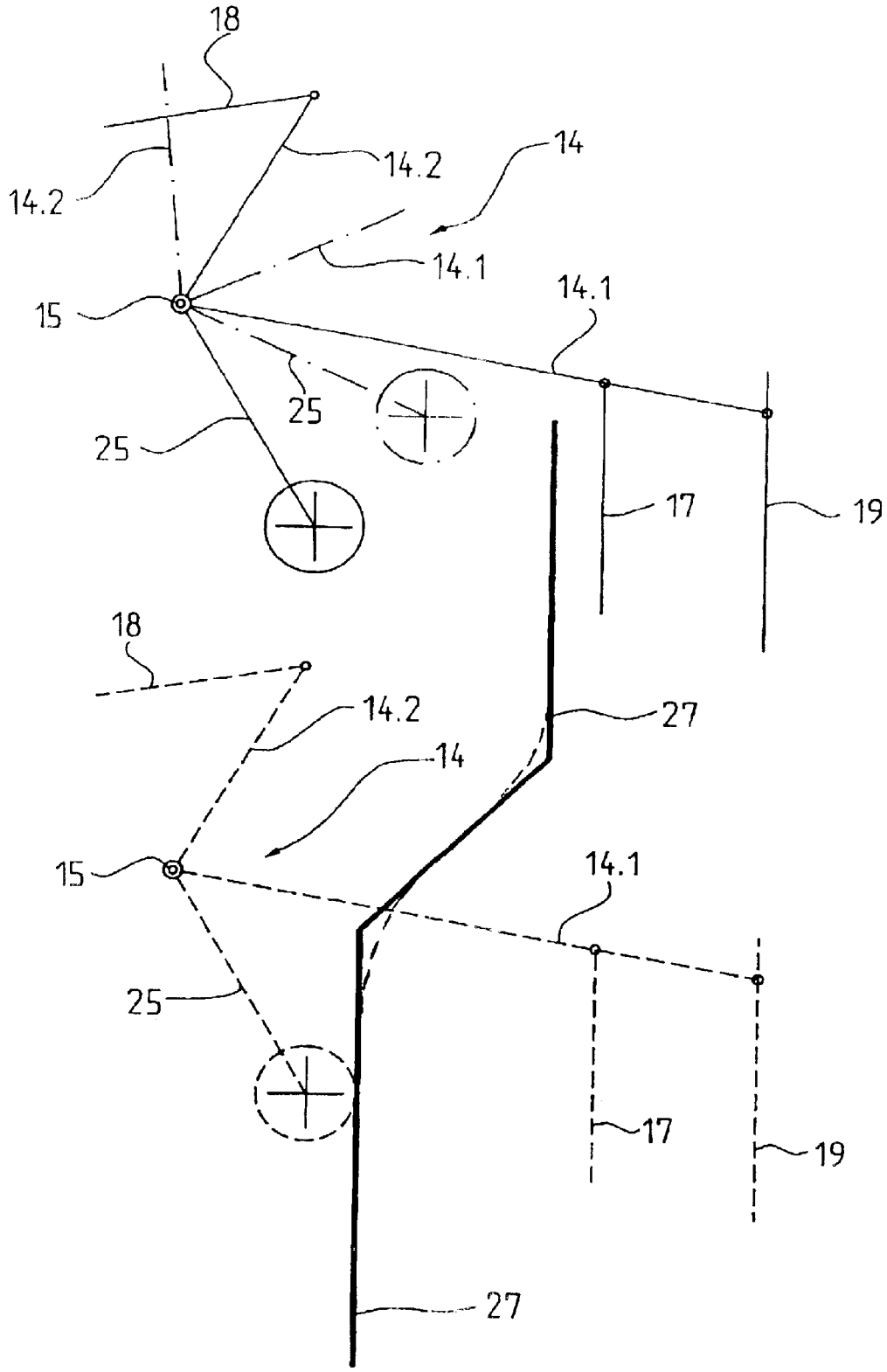
FIG. 2 is a schematic diagram presenting the details of the blocking device for blocking the safety brake.

FIG. 2 shows details of the blocking device, which is formed from the blocking lever 25 on the lift cage and blocking element 27, for blocking the safety brake 16 in the case of buffer travel. The blocking lever 25 illustrated by solid lines is shown in the position in which the lift cage stands normally at the bottom story. The blocking lever 25 illustrated by dot-dashed lines is shown in the position in which the safety brake 16 is engaged. Normally, the movement of the blocking lever 25 is not blocked by the first end of blocking element 27 which may be in the form of a curved or angled track. The blocking lever 25 illustrated by dashed lines is shown in the position in which the lift cage 2 has travelled down past the bottom story. The movement of the blocking lever 25 is blocked by the second end of the blocking element 27. The movement of the double lever 14 connected with the blocking lever 25 at the fulcrum 15 is thus also blocked. Tripping of the safety brake 16 is thus prevented.

We claim:

1. In lift equipment with a lift cage and a counterweight movable in a lift shaft having a buffer element at at least one end thereof and a safety brake which operates when excess speed of the lift cage or the counterweight occurs, the improvement comprising a blocking device for blocking operation of the safety brake having a blocking lever connected to a trip lever mechanism of the safety brake and at least one blocking element arranged in the lift shaft to control the movement of the blocking lever.

2. The improvement of claim 1 wherein the blocking element comprises a curved or angled track having a first end oriented to permit movement of the blocking lever and a second end oriented to block movement of the blocking lever.

3. The improvement of claim 2 wherein the blocking device blocks operation of the safety brake on upper buffer travel of the lift cage or counterweight and the buffer element is located at a top of the lift shaft.

4. The improvement of claim 2 wherein the blocking device blocks operation of the safety brake on lower buffer travel of the lift cage or counterweight and the buffer element is located at a bottom of the lift shaft.

* * * * *